US008015729B2

(12) United States Patent
Mizrahi Shapiro

(10) Patent No.: US 8,015,729 B2
(45) Date of Patent: Sep. 13, 2011

(54) DRAINING INSOLE FOR SHOES

(76) Inventor: Eduardo Nuri Mizrahi Shapiro, Tecamachalco (MX)

( * ) Notice: Subject to any disclaimer, the term of this patent is extended or adjusted under 35 U.S.C. 154(b) by 818 days.

(21) Appl. No.: 12/104,831

(22) Filed: Apr. 17, 2008

(65) Prior Publication Data

US 2008/0282582 A1 Nov. 20, 2008

(30) Foreign Application Priority Data

Apr. 17, 2007 (MX) ..... MX/A/2007/004606

(51) Int. Cl.
*A43B 7/08* (2006.01)
*A43B 13/38* (2006.01)

(52) U.S. Cl. ..... 36/3 B; 36/43

(58) Field of Classification Search ..... 36/3 B, 36/43, 44, 8.1
See application file for complete search history.

(56) References Cited

U.S. PATENT DOCUMENTS 4,078,321 A * 3/1978 Famolare, Jr. ..... 36/3 B
4,438,573 A * 3/1984 McBarron ..... 36/3 B
4,505,660 A * 3/1985 Seidel et al. ..... 36/3 B
4,525,940 A * 7/1985 Mochizuki ..... 36/8.1
4,894,932 A * 1/1990 Harada et al. ..... 36/3 R
4,910,882 A * 3/1990 Goller ..... 36/3 B
4,939,851 A * 7/1990 Miller ..... 36/3 B
5,809,665 A 9/1998 Suenaga
5,979,076 A 11/1999 Li
7,146,750 B2 * 12/2006 Issler ..... 36/3 B
2005/0217141 A1 * 10/2005 Cobian ..... 36/3 B

* cited by examiner

*Primary Examiner* — Ted Kavanaugh
(74) *Attorney, Agent, or Firm* — Browdy and Neimark, PLLC

(57) ABSTRACT

A draining insole for shoes that dislodges foreign objects therein is disclosed; the insole has a plurality of bridges projecting from the insole and with an upper surface on top of which the foot rests; the bridges extending wide-wise of the insole and separately distributed from each other alongside thereof. The insole also includes a plurality of channels, each one of the same separating a bridge from the other; each channel having a pair of open ends and a bottom with a gabled surface. In turn, these bridges are joined at areas where the foot might get hurt; each end of the channel is in fluid communication with one draining hole included in the shoe in order to dislodge foreign matter located at the insole.

20 Claims, 3 Drawing Sheets

SECTION B-B′

SECTION B-B′

DRAINING INSOLE FOR SHOES

FIELD OF THE INVENTION

The present invention relates to the techniques employed in the design and manufacture of shoes and, more specifically, to a draining insole for shoes that is very useful to dislodge foreign matter inside thereof; the insole also promotes ventilation towards the interior of the shoe and thermal insulation of the foot.

BACKGROUND OF THE INVENTION

The use of shoes by humans dates back to the rudimentary employment of materials from nature such as woven vegetal fibers and, later on, animal leather. Currently, it can be said that for almost any activity or occasion there exists a shoe specifically designed to meet the particular needs thereof.

For instance, the use of sandals, espadrilles, slippers, huaraches (leather sandals), diving slippers etc. is customary for leisure, rest, beach and diving activities. These shoes are characterized by their constant contact with water, their light weight and their being open to promote foot ventilation, with the exception of diving slippers that are usually closed, i.e. they cover the toes and part of or the entire instep.

Nevertheless, an issue with this type of shoes is that they constantly suffer from water, sand, stones, mud and other foreign objects going into them; this in turn is uncomfortable for the wearer's foot and, in many cases, generates foul odors due to the buildup of decomposable organic matter and, therefore, render the shoes highly unhygienic and promote the growth of fungi. For example, it is frequent when people return from the beach or camps that shoes give off unpleasant smells once they are taken out from luggage due to the accumulation of organic matter and elevated humidity inside the shoe, which promotes the incidence of fungi. In diving slippers, the removal of foreign objects inside them is particularly difficult and the wearer needs to wash them out several times to take away as much of these objects as possible, yet without achieving a 100% removal thereof.

In the prior art there exist some insoles aimed at increasing ventilation and decreasing humidity inside the shoe. For instance, in U.S. Pat. No. 5,809,665 an insole is disclosed that is characterized by ventilation holes at the lower surface thereof and intercommunicated to each other. However, it is obvious that these holes can be penetrated by foreign objects when stepping on; furthermore, said holes are not interconnected with the rest of the insole, i.e. there is no connection of the holes with the entire surface of the insole and therefore ventilation is poor at those areas of the foot not immediately above the holes.

In the same manner, U.S. Pat. No. 5,979,076 can be cited, which discloses a ventilated shoe that includes ventilating holes on the shoe sole. However, these holes do not reach out or intercommunicate in all directions inside the shoe; therefore, it would prove difficult to remove foreign objects inside the shoe through these holes.

From the above, prior-art shoes have insoles incorporated therein with the purpose of promoting a better ventilation inside the shoe. Nevertheless, should foreign objects exist inside the same such as sand, mud or other small-sized items, it may prove difficult to remove these from the shoe; in addition, the draining function has not been satisfactorily met to date.

As explained above, leisure and beach shoes need a quick removal of water in order to prevent foreign matter from accumulating and therefore generate foul odors and poor hygienic conditions. In a nutshell, the issue lies in that an insole be designed such that the wearer has little to worry about the constant cleaning of the interior of the shoe.

SUMMARY OF THE INVENTION

In order to solve the draining issues in prior-art shoes, mainly those used in leisure, rest, beach and diving activities, a draining insole is hereby designed that allows an efficient dislodging of the materials inside the shoe; additionally, the insole promotes ventilation and thermal insulation inside the shoe to freshen the foot.

More particularly, the draining insole of the present invention comprises a plurality of bridges projecting from the insole and with an upper surface on top of which the foot rests; the bridges extending wide-wise of the insole and separately distributed from each other alongside thereof. Other elements of the insole include a plurality of channels, each one of the same separating a bridge from the other; each channel having a pair of open ends and a bottom with a gabled surface; the bottom having its shallowest part located at the middle of the channel and its deepest part at each end thereof; wherein the shoe includes a plurality of draining holes, each of them being associated with and in fluid communication with one of the open ends of one of the channels in order to dislodge foreign matter located at the insole outside of the shoe.

The insole of the present invention comprising bridges and channels is both simple and practical and, in a preferred embodiment of the invention, since the bridges support the weight of the user, those insole bridges located at the heel region are bound to each other, thereby forming a first support surface on which the user can rest the heel.

Similarly, the bridges located at the insole's metatarsal region ("ball-of-foot") are bound to each other, shaping a second support surface for the metatarsal zone of the foot. Both the first and second support surfaces are useful at providing comfortableness to the foot, as in these regions most of the wearer's weight is concentrated while walking or in a stand-up position.

In a specific embodiment, the upper surface of each bridge is flat or has an ergonomic design that adapts to the contours of the user's foot sole, thereby achieving further comfort for the user when walking; i.e., creating the feel that the insole is a continuous uninterrupted surface regardless of the fact that the bridges are separated by the channels.

BRIEF DESCRIPTION OF DRAWINGS

The novelty aspects inherent to the present invention shall be set forth pursuant to the claims appended herewith. Nevertheless, the invention itself, both in its structural organization and jointly with other objects and advantages thereof, shall be better understood with the detailed disclosure of one preferred embodiment that follows, when read in conjunction with the accompanying drawings, wherein:

DETAILED DESCRIPTION OF THE INVENTION

Figure 1:
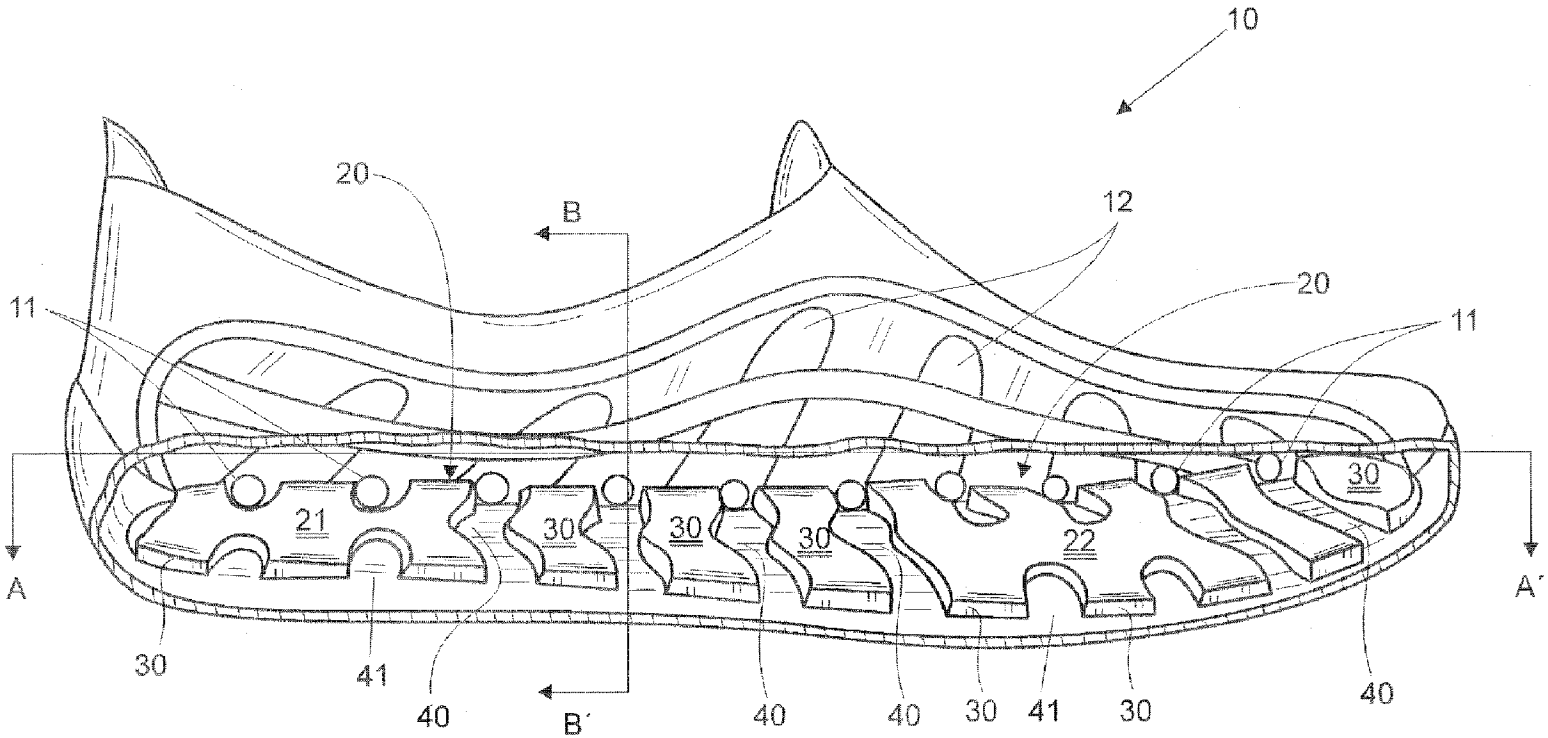
FIG. 1 is a side perspective and broken view of a shoe in the shape of a diving slipper, to which a draining insole is embedded and built in accordance with a preferred embodiment of the present invention.
Figure 2:
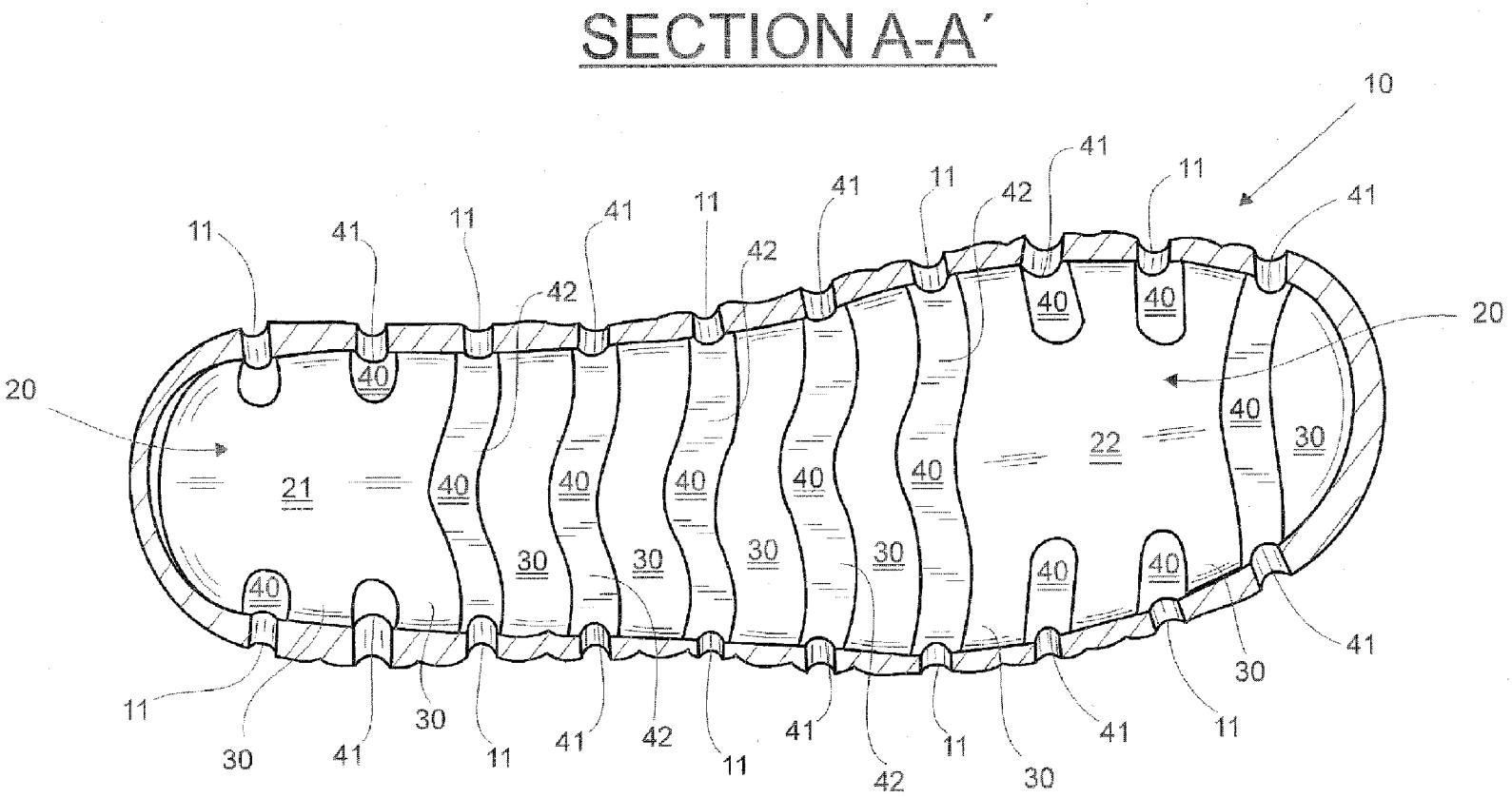
FIG. 2 is a plant view of a cut taken alongside line A-A' of the shoe of FIG. 1.

Referring to FIGS. 1 and 2 of the appended drawings there is shown a shoe 10 in the shape of a diving slipper, with ventilation openings 12 to freshen the instep of the foot. Inside the shoe 10, an insole 20 is embedded therein that is built pursuant to one preferred embodiment of the invention, which is to be deemed for illustrative but not restrictive purposes of the same. In FIG. 1, it is convenient to explain that one part of the shoe 10 has been removed in order to see the insole 20 located therein more clearly. On the other hand, FIG. 2 shows a shoe 10 cut view taken alongside line A-A' of FIG. 1; that is, it is a view wherein the upper part of the shoe 10 has been removed, leaving only the bottom part thereof in order to view the insole 20 from the top.

The insole 20 comprises a plurality of bridges 30 projecting from the insole and extending wide-wise of the insole 20 and spaced apart one from each other alongside thereof; a plurality of channels 40, each one of which separating one bridge 30 from the other. Each channel 40 has a pair of open ends 41 and a bottom 42 with a gabled surface; in other words, the bottom 42 of each channel 40 has its shallowest part located at the middle of the channel 40 and its deepest part at each end 41 thereof.

Now, in order to dislodge foreign matter located inside the insole 20 away from the shoe 10, each end 41 of each channel 40 is in fluid communication with one of the draining holes 11 included in the shoe 10. These draining holes 11 are provided on the lateral faces of the shoe sole 10, as shown in FIG. 1 or 2, or they can be provided on the lower face of the sole; i.e., in the latter case, the draining holes 11 would only be visible from a lower plant view of the shoe 10. Diameter of the draining holes 1 equals or is smaller than the width of the channels 40, so as to efficiently dislodge foreign objects inside of the shoe 10.

Regarding the bridges 30, these are spaced apart from one another by the channels 40, the separation distance is of about 0.5 cm to about 2 cm. This distance is sufficient to achieve three main objectives: the first is to make the wearer feel comfortable while walking without feeling the bottom 42 of the channels 40; the second is to allow fresh air to go into the draining holes 11 and flow throughout the length of the channels 40 in order to freshen and thermally insulate the foot sole; and the third objective is that this spaced-apart distance between the bridges 30 allows the quick removal of water and the most common foreign objects such as stones and sand within the shoe.

Likewise, in the embodiment disclosed, the bridges 30 located at the heel region of the insole 20 are bound to each other, forming a first support surface 21 on which the wearer can rest the heel. However, in order to continue the draining of this zone of the insole 20, the bridges shaping said first support surface 21 are bound by their central portion, leaving the channels 40 located between such bridges with a broken trajectory yet still connected by their ends with one draining hole 11.

In a similar fashion, the bridges 30 located at the metatarsal region of the insole 20 are bound to each other, thereby forming a second support surface 22. The bridges 30 that are joined to form said second support surface 22 are bound by their central portion, leaving the channels 40 located between said bridges with a broken trajectory, yet still connected by their corresponding ends with one draining hole 11. The first and second support surfaces 21 and 22 support most of the user's weight, whether while walking or in a stand-up position.

Figure 3:
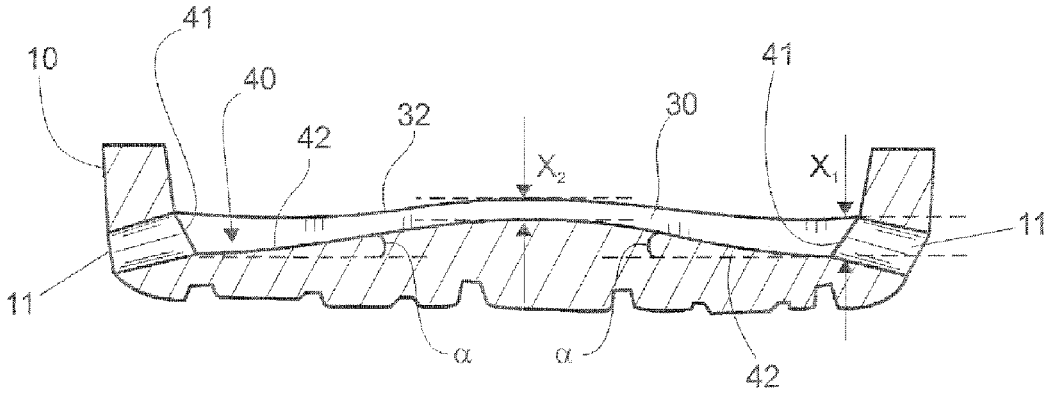
FIG. 3 is a partial view of a cross section taken alongside line B-B' of FIG. 1.
Figure 4:
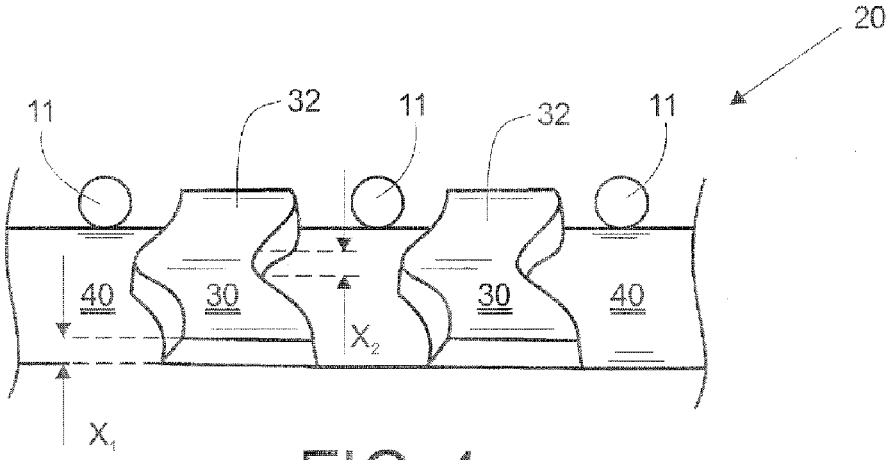
FIG. 4 is an upper side view of one pair of bridges belonging to the insole of FIG. 1.

Reference is now made to FIGS. 3 and 4 in order to appreciate the particular features of the bridges 30 and channels 40. For example, FIG. 3 clearly shows the gabling of the bottom 42 from one of the channels 40; preferably, the slant angle $\alpha$ of the bottom 42 is greater than 0° and less than 45°. On the other hand, depth $X_1$ of the bottom of the channel at its ends versus depth $X_2$ of the channel 40 at its middle part has a ratio of around 2:1 to 5:1. Both the slant angle $\alpha$ and the depth variation between depths $X_1$ and $X_2$ ensure the quick removal of any object from within the bottom of the channels 40 and exit of these materials via the holes 11 outside of the shoe 10.

In this sense, FIG. 3 also shows the fluid connection between the open ends 41 of the channel 40 and the draining holes 11. As seen in FIG. 3, the draining holes 11 have a slanted trajectory greater than that of the channel 40 bottom 42; this has the purpose of preventing the ingress of foreign objects into the shoe through the holes 11.

The bridges 30 have one upper surface 32 with an ergonomic design that adapts to the sole of the foot and is aimed at providing the wearer with comfort while walking; however, this upper surface 32 may also have a flat design. Furthermore, it is appreciated that the bridges, by extending wide-wise of the insole 20, follow a wavy trajectory; this is with the purpose of supporting the foot sole in all directions and thereby making the wearer feel that support from the insole covers the entire foot sole. Nevertheless, no restriction exists for the bridges 30 to follow a straight trajectory by extending wide-wise of the insole.

For manufacturing purposes, it is preferred that the insole be integrally bound to the shoe as a single piece. Another option to manufacture the insole is to produce the same as a separate piece of the shoe to introduce it afterwards. Regarding the manufacturing methods and materials of the insole, the latter can be produced in a mold in which thermoplastic material is injected, e.g. PVC, synthetic rubber, thermoplastic rubber (TPR), ethylene-vinyl acetate (EVA), polyurethane and thermoplastic urethane (TPU).

The insole may be incorporated into any type of shoe, yet its main application is for shoes selected from the group consisting of sandals, espadrilles, slippers, huaraches (leather sandals) and diving slippers, even more preferably the invention is used in a diving slipper.

Although the prior specification has shown and disclosed one preferred embodiment of the present invention, it will be emphasized that numerous modifications thereof are possible without deviating from the true scope of the invention. For instance, modifications may include the number of bridges, the shape of its upper surface, the separation between each bridge, etc.; therefore, the present invention cannot be restricted except for the prior art and by the appended claims.

What is claimed is:

1. A draining insole for shoes comprising:

a) a plurality of bridges projecting from the insole and having an upper surface on top of which the foot rests; the bridges extending wide-wise of the insole and separately distributed from each other alongside the insole;

b) a plurality of channels, each one of the same separating a bridge from the other; each channel having a pair of open ends and a bottom with a gabled surface; the bottom having its shallowest part located at the middle of the channel and its deepest part at each end thereof; wherein the shoe includes a plurality of draining holes, each of them being associated with and in fluid communication with one of the open ends of the channels in order to dislodge foreign matter located at the insole outside of the shoe.

2. The draining insole for shoes of claim 1, wherein the bridges located at the insole's heel region are bound to each other, thereby forming a first support surface on which the user can rest the heel.

3. The draining insole for shoes of claim 2, wherein the bridges of said first support surface are bound by their central portion, leaving the channels located between such bridges with a broken trajectory yet still connected by their ends with the draining holes.

4. The draining insole for shoes of claim 1, wherein the bridges located at the metatarsal region of the insole are bound to each other, thereby forming a second support surface for the metatarsal zone of the foot.

5. The draining insole for shoes of claim 4, wherein the bridges that are joined to form said second support surface are bound by their central portion, leaving the channels located between said bridges with a broken trajectory, yet still connected by their corresponding ends with the draining holes.

6. The draining insole for shoes of claim 1, wherein the gabling of the bottom of the channel is greater than 0° and less than 45°.

7. The draining insole for shoes of claim 1, wherein the depth of the channel at its ends versus the depth thereof at its middle part has a ratio of 2:1 to 5:1.

8. The draining insole for shoes of claim 1, wherein the draining holes included in the insole have a slanted trajectory.

9. The draining insole for shoes of claim 8, wherein the slanting of the draining holes is greater than that of the bottom of the channels.

10. The draining insole for shoes of claim 1, wherein the upper surface of the bridges is ergonomically designed to adapt to the foot.

11. The draining insole for shoes of claim 1, wherein the upper surface of the bridges is flat.

12. The draining insole for shoes of claim 1, wherein the bridges, by extending wide-wise of the insole, follow a wavy trajectory.

13. The draining insole for shoes of claim 1, wherein the bridges, by extending wide-wise of the insole, follow a straight trajectory.

14. The draining insole for shoes of claim 1, wherein the insole is integrally bound to the shoe as a single piece.

15. The draining insole for shoes of claim 1, wherein the insole is a separate piece of the shoe and introduced therein.

16. The draining insole for shoes of claim 1, wherein the insole is produced in a mold in which thermoplastic material is injected.

17. The draining insole for shoes of claim 16, wherein the thermoplastic material is selected from the group consisting of PVC, synthetic rubber, thermoplastic rubber, ethylene-vinyl acetate, polyurethane and thermoplastic urethane.

18. The draining insole for shoes of claim 1, wherein the shoe carrying the insole is selected from the group consisting of sandals, espadrilles, slippers, huaraches (leather sandals) and diving slippers.

19. The draining insole for shoes of claim 18, wherein the shoe is a diving slipper.

20. The draining insole for shoes of claim 1, wherein the draining holes are located at the shoe sole.

* * * * *